United States Patent [19]

Bell

[11] Patent Number: 4,611,392

[45] Date of Patent: Sep. 16, 1986

[54] METHOD OF MANUFACTURING RELAYS

[75] Inventor: Richard E. Bell, Princeton, Ind.

[73] Assignee: Potter & Brumfield, Inc., Princeton, Ind.

[21] Appl. No.: 698,301

[22] Filed: Feb. 5, 1985

[51] Int. Cl.[4] ..... H01H 11/00

[52] U.S. Cl. ..... 29/602 R; 29/622; 156/73.1; 264/23; 264/249

[58] Field of Search ..... 29/602 R, 622; 156/73.1, 73.5, 73.6; 264/23, 248, 249

[56] References Cited

U.S. PATENT DOCUMENTS

| | | | |
|---|---|---|---|
| 3,694,912 | 10/1972 | Sprando et al. | 29/602 R |
| 4,177,439 | 12/1979 | Smith | 335/151 |
| 4,193,181 | 3/1980 | Boulanger et al. | 29/622 X |
| 4,320,369 | 3/1982 | Bukala | 335/202 |
| 4,344,103 | 8/1982 | Nagamoto et al. | 361/160 |
| 4,475,093 | 10/1984 | Kobler | 335/78 |
| 4,482,876 | 11/1984 | Stadler et al. | 335/83 |
| 4,490,705 | 12/1984 | Mueller | 335/276 |

*Primary Examiner*—Carl E. Hall

*Attorney, Agent, or Firm*—John F. Moran

[57] ABSTRACT

A method of assembling electromagnetic relays by securing and aligning the magnetic pole pieces in the base of the relay through the use of ultrasonic reformation of the base material.

4 Claims, 5 Drawing Figures

METHOD OF MANUFACTURING RELAYS

This invention relates generally to to a method of manufacturing miniature electromagnetic relays. An example of the type of relay contemplated by this manufacturing procedure is a polarized electromagnetic relay which comprises an electromagnetic assembly and an electric switching assembly. An example of such a relay is disclosed in U.S. Pat. No. 4,344,103 which is herein incorporated by reference.

The relays produced by this manufacturing method typically comprise a magnet mounted between two pole pieces embedded within a plastic base. Terminal pins are molded into the base material and provide the electrical connection between the stationary contact leads, the movable arm contact leads and the leads to an electromagnetic coil. The base is utilized to retain the parts of the relay in their desired relationship.

When the relay is completely assembled with the magnet charged, the movable armature is moved by the magnetic to one side toward one of the pole pieces. This "normally closed" position of the relay is created by the movement of the armature and the pusher assembly and creates an electrical connection between the movable contacts and the outside normally closed (NC), stationary contacts. The armature movement against the movable contact arm must be of a sufficient force to create and maintain the required electrical connection between these contacts. Also, when the armature is moved toward the NC position pole piece, the second movable contact arm on the opposite side of the armature creates its electrical connection with its corresponding NC contacts on the inside stationary leads.

When the relay coil is energized the magnetic pull moves the armature toward the opposite pole piece with a sufficient force to push the second movable contact arm away from its inside NC position to create an electrical connection between the outside, or normally open (NO), stationary contacts. Also, the armature and pusher assembly motion away from the NC position released the first movable contact arm and allows it to make an electrical connection with its corresponding inside NO stationary contacts.

For reliable relay operation having sufficient longevity, the moving parts of the relay must be assembled and secured in a preset relationship. Also, the mechanical motion of the relay during operation must not create a misalignment between the interconnecting contacts. The critical dimensions of a miniature relay also includes the air gap between open contacts. The spacing between open contacts must be sufficient to prevent electrical arcing between these contacts and must be maintained over the useful life of the relay. Another requirement is that sufficient pressure must be provided between the closed contacts by the movement of the armature and pusher assembly. This pressure is created by an overtravel of the armature against the spring force of the movable contact arm and is partially dependant on the alignment of the pusher assembly against the movable arm. Also, the movable contact arm must have a sufficient spring force to close the contacts on the inside stationary leads when the armature and pusher assembly moves to the opposite side of the relay.

Previous methods of manufacturing this type relay to secure the relay parts, such as the pole pieces and the magnet, within the base include a press fit procedure and the use of epoxies or glues. Press fitting these parts into the base is undesirable due to the significant tolerance and dimensional requirements of a miniature relay. A press fit method tends to misalign the contact leads when the base is spread to permit entry of the magnet and pole pieces. The forcing action to insert the parts upsets the positioning of the stationary contact pieces and the movable contacts, all of which are molded in a preset position into the base of the relay. Any permanent misalignment of these contact leads could severely effect the operation of the relay or could cause malfunctions after continuous relay operation over a period of time. In either instance the result is relay failure.

The use of the glues or resins to secure parts to the base is undesirable because it requires careful application and curing. When using this type of procedure some of the material applied tends to flow into undesired areas, such as between the magnet and pole pieces, causing a break in contact between these adjoining parts or a misalignment of the coil and armature with respect to the movable contact arms.

Therefore, it is the object of this invention to provide a method of manufacture of miniature electromagnetic relays which overcomes the problems of the prior known methods.

Also, it is the object of this invention to manufacture electromagnetic relays having the proper tolerances between moving parts while securing these parts to the base of the relay.

A further object of this invention is to manufacture relays simply and at a low cost while producing a highly reliable product having sufficient longevity.

The preferred method of manufacturing relays so contemplated by this invention comprises the mounting of two pole pieces and a magnet in approporiate recesses in a molded base. The initial mounting or placement of these parts is performed loosely without forcing or press fitting into the recesses. The base material, which is preferably a thermoplastic such as a polamide (PA) type 66 nylon, is reformed in appropriate locations by an ultrasonic staking means such as that described in U.S. Pat. No. 3,483,611 which is herein incorporated by reference. The ultrasonic stakes or reformations are applied at strategic locations by a tool which reforms the base material against the sides of the pole pieces to secure their aligned position. The reformation of the base material also includes a movement of the material over the top of the pole pieces to prevent vertical misalignment and to tightly secure the parts during mechanical motion of the armature and the movable contact arms.

Thus, after completion of the reformation procedure the mounted parts are secured into the base of the relay without affecting the preset relationship between the stationary contact leads or the adjoining contacts on the movable arm.

Further objects and advantages of this invention will become apparent upon particularly describing the preferred method of producing this type relay.

DETAILED DESCRIPTION OF THE DRAWINGS

Figure 1:
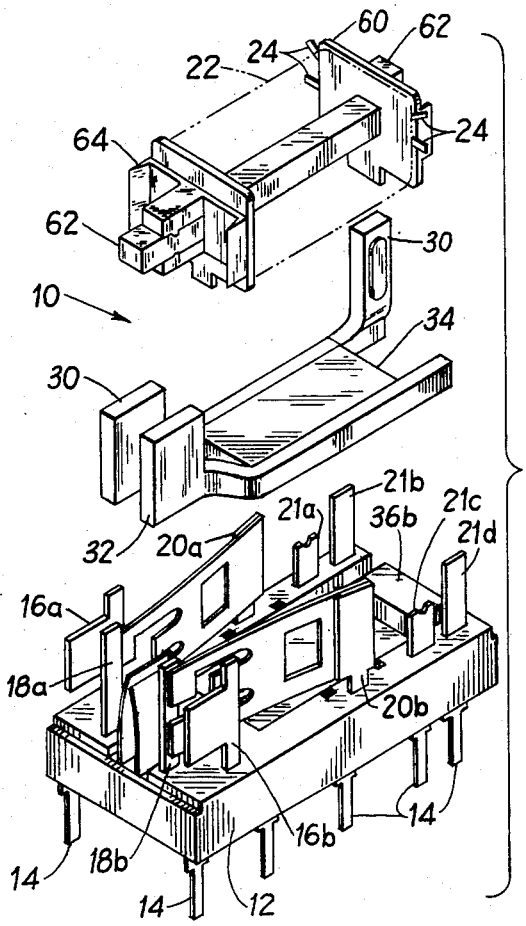
FIG. 1 is an exploded view of a typical relay prior to assembly.

FIG. 1 shows the construction of a typical relay 10 in exploded view indicating the assembly relationship of the relay parts. The relay 10 has having a series of terminal pins 14 which are mounted into the base 12. The base 12 is formed by injection molding, with the pins 14 being set into its preset position during curing. Each terminal pin 14 extends below the base 12 for connection to a printed circuit (PC) board and also connects through to various parts on top of the base 12. One set of pins 14 as shown in FIG. 1 electrically connect to the outside stationary contact leads 16*a*, 16*b* on either side of the base 12. Another set of terminal pins 14 corresponds to the inside contact leads 18*a*, 18*b* located on either side of the base 12. Still, another set of terminal pins 14 correspond to the movable contact arms and their leads 20*a* and 20*b*. The remaining terminal pin sets 14 connect to leads 21*a*, 22*b*, 21*c*, 21*d* for attachment to the wires 24 extending from the relay coil 22.

Figure 4A:
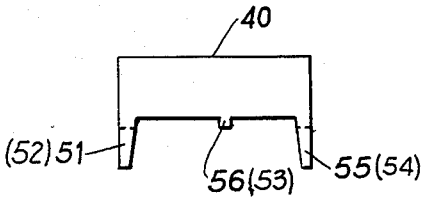
FIGS. 4*a* and 4*b* show the tool used for assembling the relay.
Figure 4B:
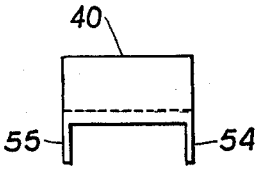
Figure 2:
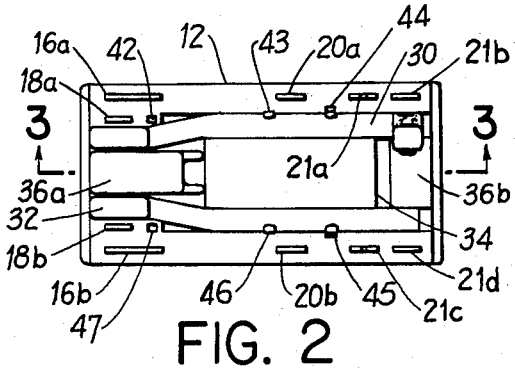
FIG. 2 is a top view of the base of the typical relay after assembly by the method of this invention.
Figure 3:
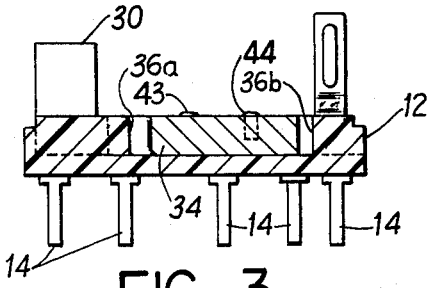
FIG. 3 is a side view of FIG. 2 along line 3—3.

Mounted inside the base 12 are two pole pieces 30, 32 and a permanent magnet 34. The base 12 is provided with appropriate slots or recesses for the placement of these pole pieces 30, 32 and is also provided with alignment blocks 36*a* and 36*b* adjacent to these recesses for positioning the ends of the pole pieces 30, 32 and the magnet 34. When the two pole pieces 30, 32 and magnet 34 are loosely placed into their appropriate slots in the base 12, a tool 40 is lowered into position for application of the ultrasonic welds. The reformation or stakes 42, 43, 44, 45, 46 and 47 in the base 12 are shown in FIG. 2 at various locations along the outside edge of the pole pieces 30, 32. The tool 40 for producing these reformations in the base 12 is shown in FIGS. 4*a* and 4*b*.

Stakes 42 and 47 are preferrably produced by two deep staking posts 52, 51 on tool 40. The pole pieces 30, 32 are placed within the recesses of the base 12 and then centered for proper alignment with the contact leads. Stakes 42, 47 reform the base material to bind the front end of the pole pieces 30, 32 in this aligned position. Stakes 43 and 46 are made from flat staking posts 53, 56 on tool 40 and are designed to reform the material of the base 12 so that it extends over the top edge of the pole pieces 30, 32 to prevent removal of the parts from the recesses in the base 12. The remaining stakes 44, 45, as shown, are produced by staking posts 54 and 55 on tool 40. These particular stakes 44, 45 as are preferably of the deep staking post type similar to stakes 42, and 47, described previously, and are designed to tightly bind the pole pieces 30, 32 within the base 12 against the magnet 34 in the center alignment position. Also, the corresponding staking posts 54, 55 on tool 40 produce a flap similar to those produced by flat staking posts 53, 56. These flaps prevent vertical removal or misalignment of the pole pieces 30, 32 from the base 12. It should be noted that this center alignment position does not necessarily bring pole pieces 30, 32 in contact with the alignment blocks 36*a* or 36*b*. The center alignment position is more dependant on the preset contact lead positioning.

After mounting of the pole pieces 30, 32 and the magnet 34 in the manner described above, the bobbin 60 and its coil 22 are placed into position above the base 12 along with the armature 62 and pusher assembly 64. The armature 62 extends through the bobbin 60 with one end adjacent to pole piece 30 to define the NC position. The pusher assembly end of the armature 62 is placed between the upward extensions of both pieces 30, 32 adjacent to alignment block 36*a*. The pusher assembly 64 is mounted on the armature 62 and extends toward the appropriate movable contact arm 20*a*, 20*b*. The position of the armature 62 depends on the condition of the coil 22 in creating the electrical switching action as described above.

Having described the preferred embodiment of the invention and its advantages and features, what is claimed is:

1. A method of manufacturing electromagnetic relays, comprising the steps providing a plurality of contact leads and electrically interconnected terminal pins in a given pattern, providing a mass of thermoplastic electrical insulating material, molding the plurality of leads and pins in their given pattern into a base member of said thermoplastic insulating material and molding a recessed portion into one surface of the base member, said recessed portion being adapted to loosely receive a relay magnet structure that includes at least two pole pieces, inserting a magnet structure with pole pieces to fit loosely in said recessed portion in the base, at a first plurality of locations along the periphery of said recessed portion, and adjacent the magnet structure, reforming the thermoplastic material against the sides of the magnet structure to thereby tightly bind the magnet structure in a desired aligned position in said base, and at a second plurality of locations at the periphery of the recessed portion, and adjacent the magnet structure, reforming the thermoplastic material of the base to form flaps that extend over the magnet structure to prevent withdrawal of the magnet structure from the recessed portion of the base.

2. The method of manufacturing electromagnetic relays claimed in claim 1 wherein the step of reforming the thermoplastic insulating material at said first plurality of locations is performed by inserting staking posts into the thermoplastic material adjacent the sides of the magnet structure to reform the thermoplastic material against the sides of said structure.

3. The method of manufacturing electromagnetic relays claimed in claim 2 wherein the step of reforming the thermoplastic material at said second plurality of locations is performed by forcing flat staking posts into said material adjacent the magnet structure.

4. The method of manufacturing electromagnetic relays claimed in claim 3 wherein the two recited steps of reforming the thermoplastic material at the first and second pluralities of locations includes the step of forcing a staking tool into said base member, wherein deep staking posts of said tool are forced into said first plurality of locations and flat staking posts of the tool are forced into said second plurality of locations.

* * * * *